US007014566B1

(12) United States Patent
Norvise

(10) Patent No.: US 7,014,566 B1
(45) Date of Patent: Mar. 21, 2006

(54) GOLF PUTTER

(76) Inventor: Michael Norvise, 1931 Turtle Rock St., Las Vegas, NV (US) 89142

( * ) Notice: Subject to any disclaimer, the term of this patent is extended or adjusted under 35 U.S.C. 154(b) by 0 days.

(21) Appl. No.: 10/826,450

(22) Filed: Apr. 19, 2004

(51) Int. Cl.
*A63B 53/04* (2006.01)

(52) U.S. Cl. ..... 473/231; 473/238; 473/242; 473/251

(58) Field of Classification Search ..... 473/231, 473/238, 242, 251, 252, 255, 340–341; D21/742–746
See application file for complete search history.

(56) References Cited

U.S. PATENT DOCUMENTS

| | | | | | |
|---|---|---|---|---|---|
| 653,023 | A * | 7/1900 | Holden | 473/251 |
| 837,030 | A * | 11/1906 | Blanchard | 473/201 |
| 1,659,231 | A * | 2/1928 | Baack | 473/251 |
| 2,503,506 | A * | 4/1950 | Miller | 473/251 |
| 2,820,638 | A * | 1/1958 | Morrison | 473/252 |
| 3,292,928 | A * | 12/1966 | Valentine | 473/244 |
| 3,698,093 | A * | 10/1972 | Marshall | 33/263 |
| 3,880,430 | A * | 4/1975 | McCabe | 473/253 |
| D235,668 | S * | 7/1975 | Swash | D21/739 |
| 3,955,819 | A * | 5/1976 | Yokich | 473/252 |
| 4,002,343 | A * | 1/1977 | Eckert | 473/251 |
| 4,138,117 | A * | 2/1979 | Dalton | 473/255 |
| 4,325,553 | A * | 4/1982 | Taylor | 473/337 |
| 4,869,507 | A * | 9/1989 | Sahm | 473/337 |
| 4,986,544 | A * | 1/1991 | Benson | 473/254 |
| 5,340,106 | A * | 8/1994 | Ravaris | 473/328 |
| 5,470,070 | A * | 11/1995 | Bendo | 473/252 |
| 5,542,675 | A * | 8/1996 | Micciche et al. | 473/329 |
| 5,913,730 | A * | 6/1999 | Johnson | 473/204 |
| 6,273,827 | B1 * | 8/2001 | Hockerson et al. | 473/236 |
| 6,482,100 | B1 * | 11/2002 | Bacon | 473/240 |

* cited by examiner

*Primary Examiner*—Sebastiano Passaniti
(74) *Attorney, Agent, or Firm*—Leonard Weiss

(57) ABSTRACT

A hard rubber plate forms a striking surface that covers most of a front face of a body of a club head of a putter. The thickness of the plate prevents an uncovered edge of the front face from striking a golf ball. The front face has an arcuate shape that indicates a part of the striking surface that ideally strikes the golf ball. A sighting fin extends rearward from the front face. The fin has a horizontal sighting surface that provides sighting in a direction perpendicular to the striking surface. The body has a plurality of threaded holes wherein a screw is engaged to provide a desired weight and distribution of weight of the club head. When a mallet putter is oriented with its hosel extending vertically above its body, a bottom of the mallet putter's body slopes upward from its front face to a back of the body. Disadvantages of a large front to back length of a mallet putter are obviated by the upward slope.

7 Claims, 5 Drawing Sheets

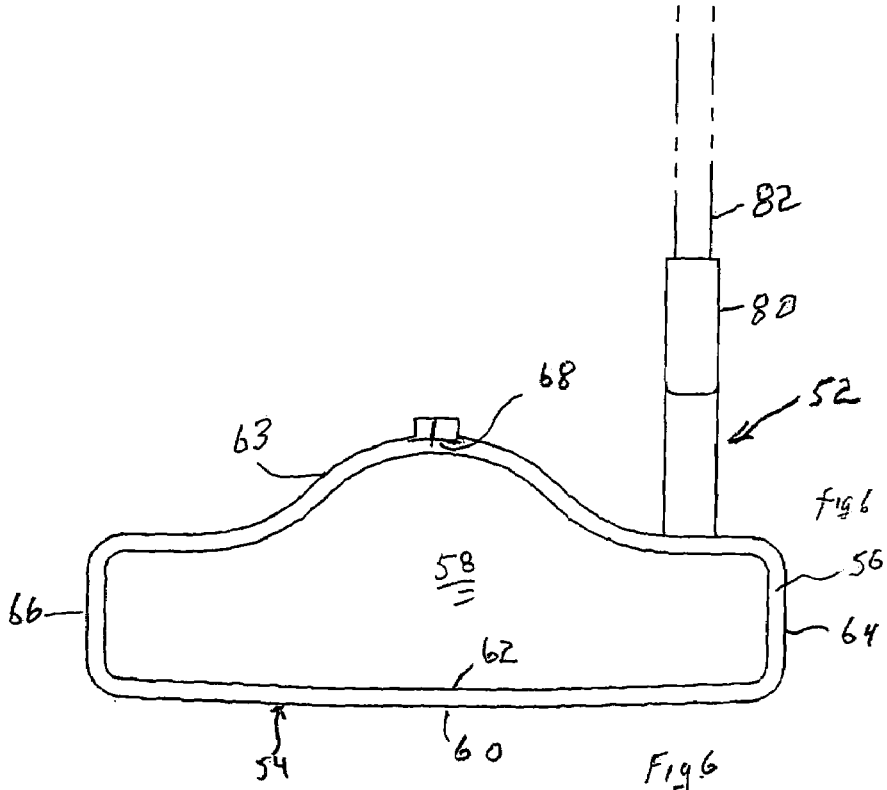
Fig 6
Fig 6
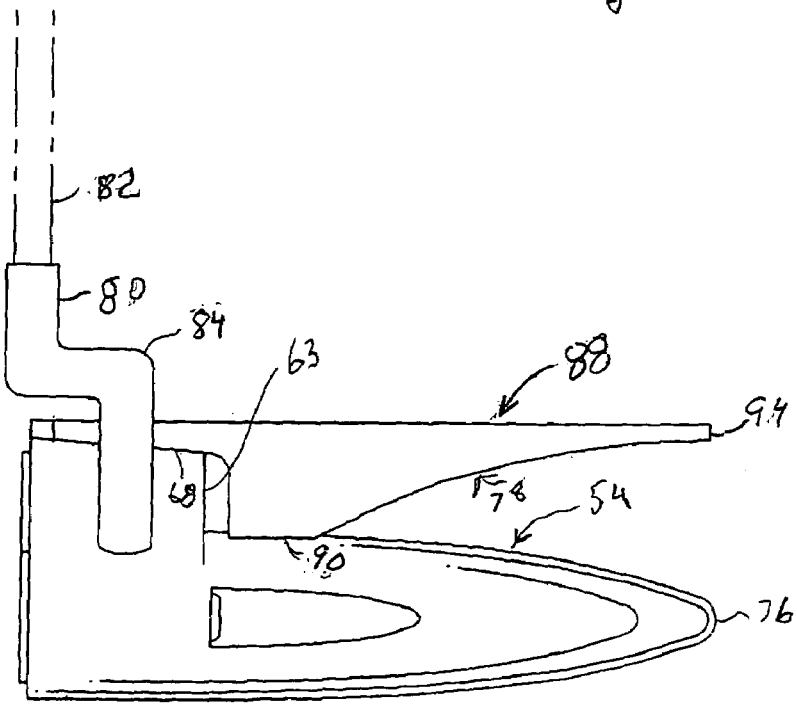
Fig. 7

GOLF PUTTER

FIELD OF INVENTION

This invention is in the general field of golfing and, more particularly, is a golf club known as a putter.

DESCRIPTION OF THE PRIOR ART

A putt is a golfing stroke that is used to propel a golf ball a short distance to a hole on a golf course.

Every time a golfer makes a correct putting stroke, a club head of the putter moves back and forth along a straight line. When a hole is on a flat surface, the golfer makes a straight putt whereby the ball rolls to the hole when the ball is aimed at the hole. One aid to aiming is to aline a label of the ball with the hole.

When a vicinity of the hole is not flat, the ball probably will curve after it is hit. The curving is referred to as a break. The golfer makes a breaking putt when the vicinity of the hole is not flat.

The only difference between the straight putt and the breaking putt is where the putter is aimed. On a breaking putt the proper aim is to a high side of the hole to let gravity take the ball down a slope to the hole. Therefore, it is essential that the golfer properly aim the ball for either the straight putt or the breaking putt.

The golfer may desire a modification of weight of a putter to gain a proper feel and rhythm to properly stroke the ball. The modification has heretofore been unavailable.

SUMMARY OF THE INVENTION

According to a first aspect of the present invention, a plate covers most of a front face of a club head, thereby providing a striking surface. A narrow space along a bottom edge of the front face is not covered by the plate. The thickness of the plate prevents the bottom edge from striking a golf ball.

According to a second aspect of the present invention, the front face has an arcuate shape that causes a vertical distance from the bottom edge to a top of the front face to be greatest midway between a heel and a toe of the club head. The arcuate shape provides a golfer with a visual indication of a part of the striking surface that should ideally strike the golf ball.

According to a third aspect of the present invention, a putter includes a sighting fin that extends rearward from the front face, along a center of a top of the club head. Near the front face, the fin forms a pointer that points in a direction perpendicular to the striking surface.

According to a fourth aspect of the present invention, the club head has a plurality of threaded holes wherein a screw is engaged to provide a desired weight and distribution of weight of the club head.

According to a fifth aspect of the present invention, when a mallet putter is oriented with its hosel extending vertically above its club head, a bottom of the mallet putter's club head slopes upward from a front face of the mallet putter to a back of the club head of the mallet putter.

Other objects, features, and advantages of the invention should be apparent from the following description of the preferred embodiment thereof as illustrated in the accompanying drawing.

BRIEF DESCRIPTION OF THE DRAWING

FIG. 6 is a plan view of a striking surface of a mallet putter in accordance with a second embodiment of the present invention;

FIG. 7 is a side elevation of the putter of FIG. 6;

DESCRIPTION OF THE EMBODIMENTS

Figure 1:
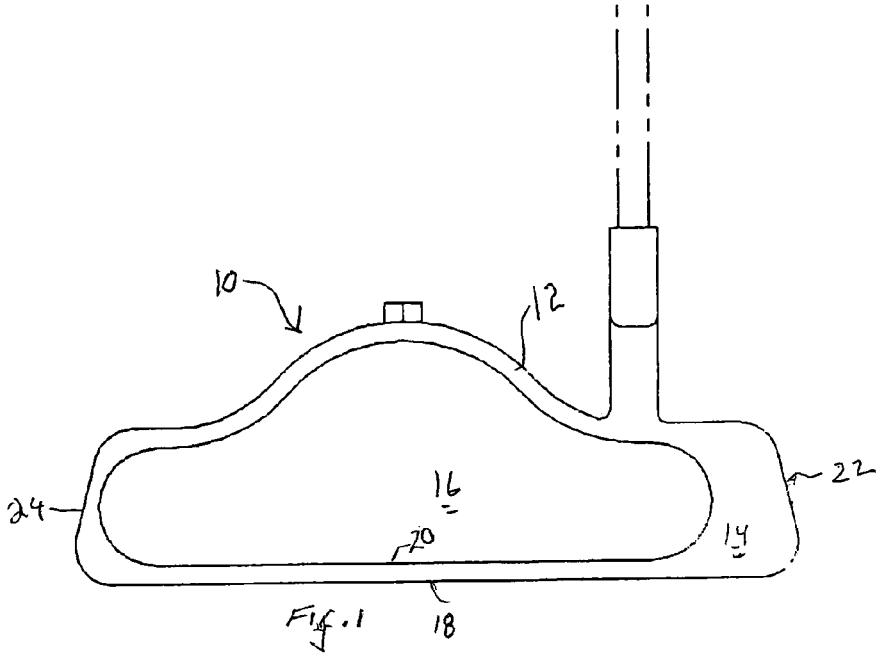
FIG. 1 is a plan view of a striking surface of a blade putter in accordance with a first embodiment of the present invention.
Figure 2:
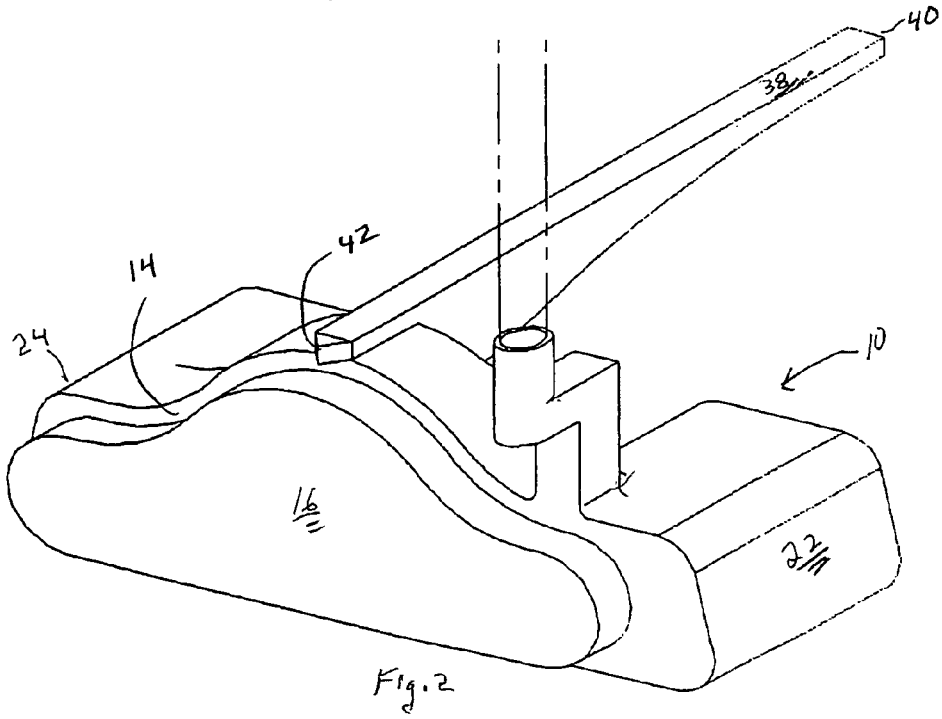
FIG. 2 is a perspective view of the striking surface, top and heel of the putter of FIG. 1.
Figure 3:
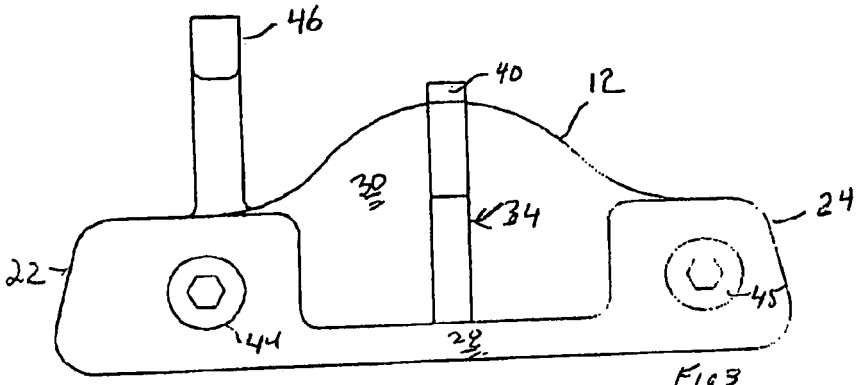
FIG. 3 is a plan view of the rear of putter of FIG. 1.
Figure 4:
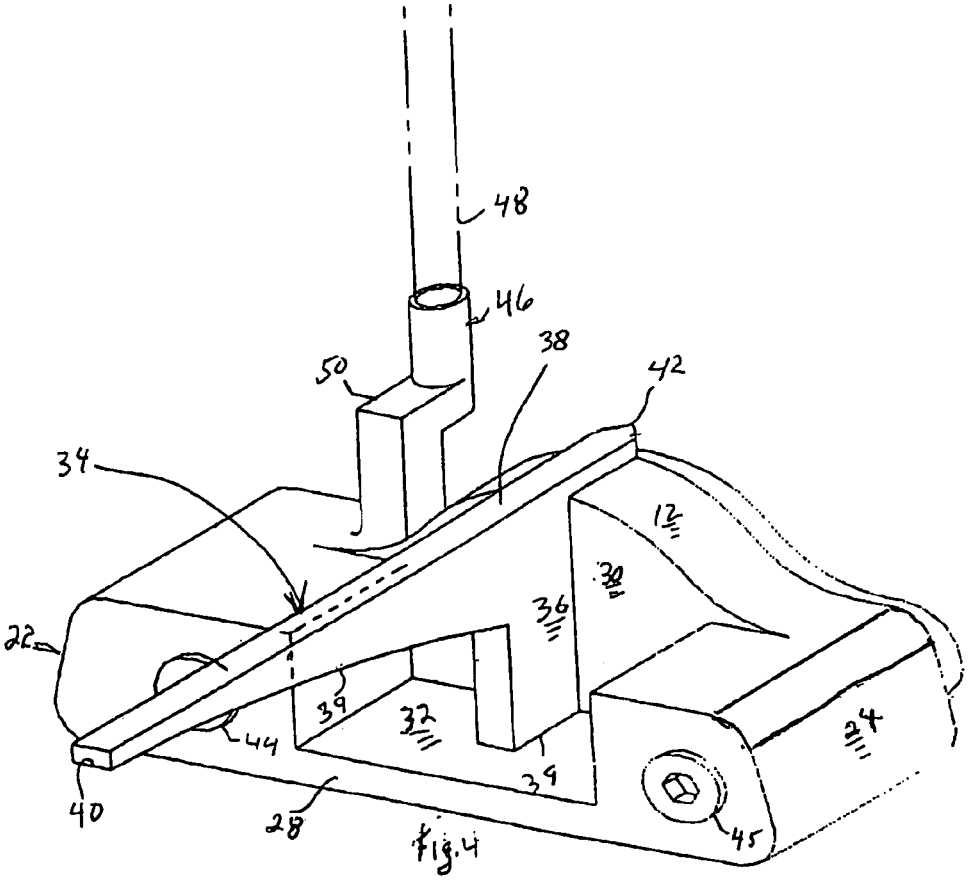
FIG. 4 is a perspective view of the rear, top and toe of the putter of FIG. 1.

A golfer uses one of two types of putters. A first type is a blade putter. A second type is a mallet putter. The mallet putter has a club head that is usually larger and heavier than a club head of a blade putter. A choice of which type of putter to use is in accordance with a preference of the golfer.

As shown in FIGS. 1–5, in a first embodiment, a blade putter 10 has a body 12 that is made from titanium. The body 12 has a front face 14 (FIGS. 1 and 2) upon which a hard rubber plate 16 is fixedly mounted. The plate 16 provides a striking surface for the blade putter 10 that covers most of the face 14.

There is a separation between a bottom edge 18 of the face 14 and a bottom edge 20 of the plate 16. The thickness of the plate 16 prevents a golf ball from contacting the edge 18 when a golf ball is struck by the striking surface.

An upper part of the face 14 has a symmetric curvilinear shape between a heel 22 and a toe 24 of the body 12. The face 14 is highest approximately midway between the heel 22 and the toe 24. Ideally, a golfer hits the golf ball with a part of the plate 16 that is midway between the heel 22 and the toe 24. While putting, the curvilinear shape of the face 14 provides to the golfer a visual indication of where the striking surface should strike the golf ball.

A rear portion of the body 12 (FIGS. 3 and 4) has a cut-out region between a rear wall 28 and a cut-out wall 30. The cut-out Region has a bottom 32. Within the cut out region is sighting fin 34. The fin 34 has a support part 36 that is connected to the wall 30 and the bottom 32.

Figure 5:
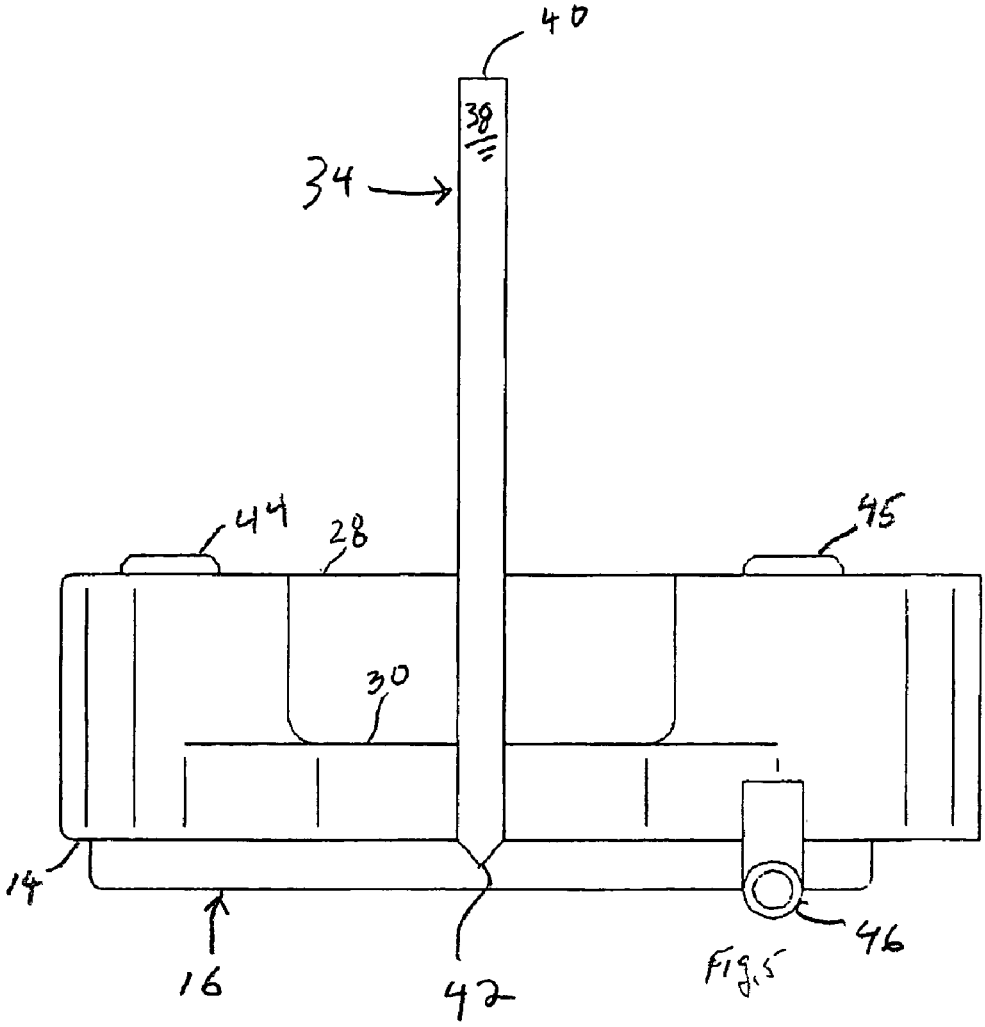
FIG. 5 is a plan view of top of the putter of FIG. 1.
Figure 8:
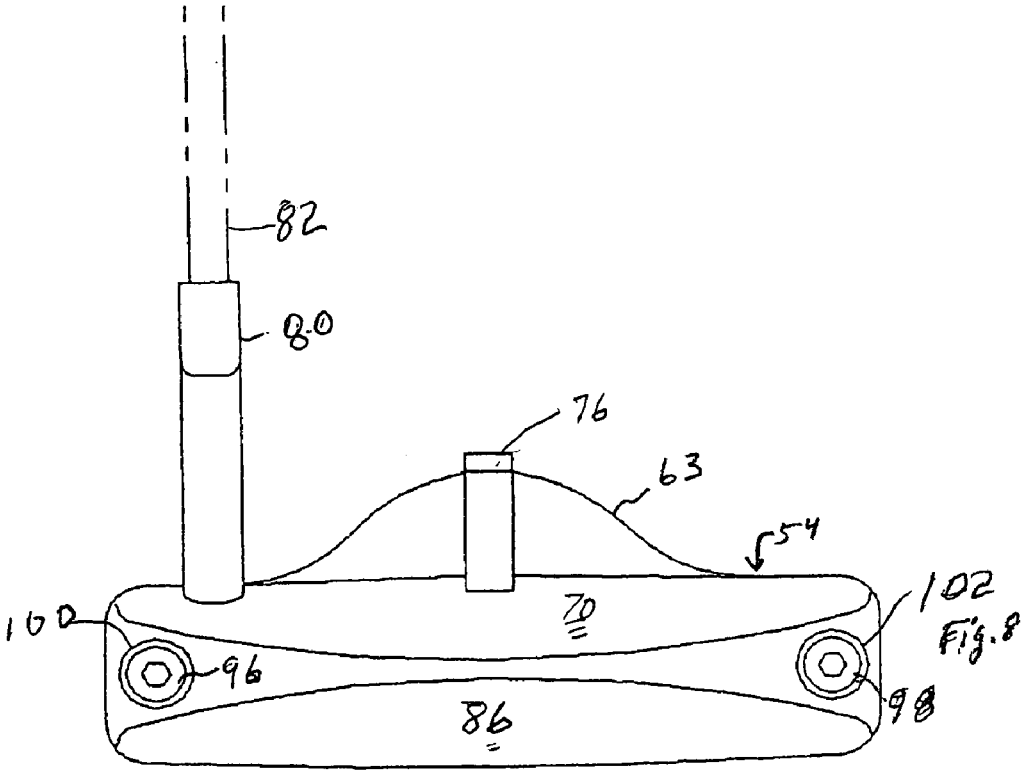
FIG. 8 is a rear view of the putter of FIG. 6.
Figure 9:
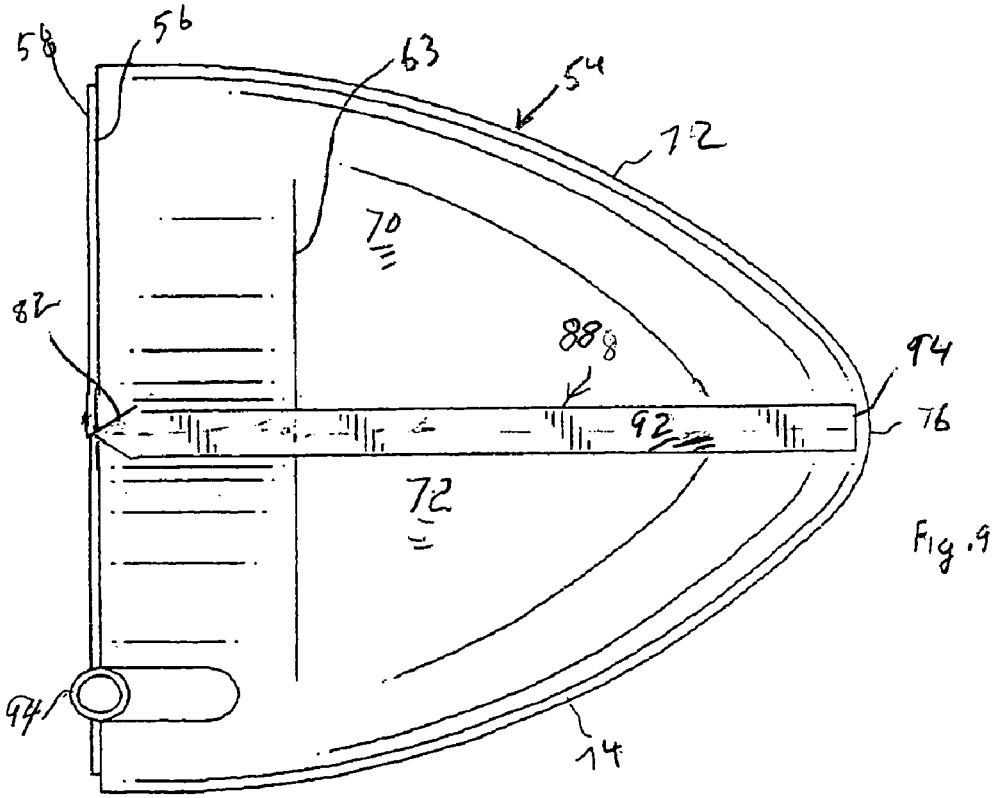
FIG. 9 is a plan view of the top of the putter of FIG. 6.

The fin 34 has a top edge referred to as a horizontal sighting surface 38. The fin 34 additionally has a bottom edge 39. An end 40 of the fin 34 is at a location rearward of the wall 28. The bottom edge 39 extends along a centerline (not shown) of the body 12, to a region proximal to a boundary formed by the plate 16 and the face 14 (FIG. 5).

Proximal to the boundary, the fin 34 forms a pointer 42 that points in a direction perpendicular to the striking surface. Therefore, a player who sights along the surface 38 is sighting in a direction perpendicular to the striking surface.

The purpose of the cut-out region is to eliminate weight from the body 12. Weight, and distribution of weight, of the body 12 is controlled by screwing allen head bolts 44, 45 of a selected weight into holes in the body 12. A plurality of bolts of various weights are provided to the golfer thereby permitting the golfer to adjust the club weight and distribution of weight as desired.

In this embodiment, a hosel 46 for a shaft 48 of the blade putter 10 is connected to one end of an L shaped mounting adapter 50. The other end of the adapter 50 is connected to the body 12. It should be understood that many other types of adapters may be used.

As shown in FIGS. 6–9, in accordance with a second embodiment, a mallet putter 52 has a body 54 that is made from titanium. The body 54 has a front face 56 (FIG. 6) upon which a hard rubber plate 58 is fixedly mounted, in a manner similar to the mounting of the plate 16, to provide a striking surface as in the first embodiment.

Similar to the blade putter of the first embodiment, an upper part 63 (FIGS. 6 and 7) of the body 54 has a symmetric curvilinear shape between a heel 64 and a toe 66 thereof. The body 54 is highest along a midway region 68 between the heel 64 and the toe 66 thereby providing the golfer with the visual indication of a part of the striking surface that should ideally strike the golf ball.

A lower part 70 (FIGS. 8 and 9) of the body 54 has curvilinear sides 72, 74 that extend rearward from the part 63 to converge at the rear 76 of the putter 52.

A hosel 46 for a shaft 82 of the mallet putter 52 is connected to one end of an L shaped mounting adapter 84. The other end of the adapter 84 is connected to the body 54. When the mallet putter 52 is oriented with the hosel 46 extending vertically above the body 54, a bottom 86 of the body 54 extends from the face 56 along a curvilinear upward path to the rear 76.

It should be understood that a front to back horizontal distance from the face 56 to the rear 76 is greater than a front to back horizontal distance from the front face 14 to the rear wall 28 of the blade putter 10. The curvilinear upward path of the bottom 86 obviates any disadvantage that may be encountered because of the front to back horizontal distance of the mallet putter 52.

A sighting fin 88 is connected to the midway region 68 and to the lower part 70 (FIG. 7) along a central region 90 thereof. A horizontal sighting surface 92 of the fin 88 has an end 94 at a location approximately above the rear 76. The sighting surface 92 extends over the region 68 to a boundary formed by the plate 58 and the face 56 (FIG. 9) where edges of the fin 88 form a pointer that points in a direction perpendicular to the striking surface of the mallet putter 52. Therefore, a golfer who sights along the surface 92 is sighting in a direction perpendicular to the striking surface of the mallet putter 52.

Weight, and distribution of weight, of the body 54 is controlled by screwing allen head bolts 96,98 of a selected weight into threaded holes 100,102, respectively, in the body 54. A plurality of bolts of various weights are provided to the golfer thereby permitting the golfer to adjust the club weight and distribution of the club weight as desired.

I claim:

1. A club head of a golf putter comprising:

a metal body;

a plate fixedly connected to a front face of the body, said plate forming a striking surface of said club head; said front face being symmetrical about a centerline between a heel and a toe of the body;

a sighting fin having a horizontal sighting surface extending along the centerline of the body over the highest part of the body and further extending rearwardly from a region rearward of a plane containing said striking surface and proximal a boundary between said plate and a plane of the front face; said fin further including edges located proximal said boundary and forming a pointer that points away from the body in a direction perpendicular to said striking surface.

2. The club head of a golf putter of claim 1 wherein said plate is a hard rubber plate.

3. The club head of a golf putter of claim 1 having a separation between a bottom edge of said front face and a bottom edge of said plate, said plate having a thickness that prevents a golf ball from contacting the edge of said front face when the striking surface strikes the ball.

4. The club head of a golf putter according to claim 1 wherein the body has a cut-out region between a rear wall of said body and a cut-out wall of said body, additionally comprising: a support part of said fin that is connected to the body within the cut-out region.

5. The club head of a golf putter according to claim 1 additionally comprising: a hosel connected to the body, the body having a bottom that extends from said front face along a curvilinear upward path to a rear of the body when the putter is oriented with the hosel extending upward.

6. The club head of claim a golf putter of claim 1 additionally comprising means for changing weight and distribution of weight of said club head.

7. The club head of a golf putter of claim 6 wherein said means comprises a plurality of threaded holes within said body; and a plurality of bolts that are screwed into said holes for changing weight and distribution of weight of said club head.

* * * * *